United States Patent [19]

Junck et al.

[11] 4,109,561

[45] Aug. 29, 1978

[54] CONTROL VALVE ARRANGEMENT WITH A PRECONDITIONED RELIEF VALVE AND A FLOW FORCE COMPENSATED VALVE SPOOL

[75] Inventors: John A. Junck; Larry W. Lorimor, both of Joliet, Ill.

[73] Assignee: Caterpillar Tractor Co., Peoria, Ill.

[21] Appl. No.: 745,508

[22] Filed: Nov. 26, 1976

[51] Int. Cl.[2] ..... F15B 11/08; F15B 13/04

[52] U.S. Cl. ..... 91/451; 137/596.13; 137/625.3

[58] Field of Search ..... 137/596.13, 625.3, 625.69; 91/451

[56] References Cited

U.S. PATENT DOCUMENTS

| | | | |
|---|---|---|---|
| 2,941,547 | 6/1960 | Rodd | 137/596.13 |
| 3,602,104 | 8/1971 | Stremple | 137/596.13 X |
| 3,707,988 | 1/1973 | Hodgson | 137/596.13 X |
| 3,847,180 | 11/1974 | Kroth et al. | 137/596.13 |
| 3,878,864 | 4/1975 | Schurger | 91/451 X |
| 3,882,896 | 5/1975 | Budzich | 91/451 X |
| 3,902,401 | 9/1975 | Allen et al. | 91/451 X |
| 3,924,655 | 12/1975 | Schwerin | 137/625.69 X |
| 3,971,216 | 7/1976 | Miller | 137/596.13 X |

*Primary Examiner*—Irwin C. Cohen

*Attorney, Agent, or Firm*—Charles E. Lanchantin, Jr.

[57] ABSTRACT

A control valve arrangement is disclosed for regulating fluid communication between a source of fluid under pressure and a double-acting hydraulic motor, including a housing defining a bore, an inlet chamber in communication with the bore and the pressure source, a pair of service chambers in communication with the bore and the hydraulic motor for actuation thereof, and a plurality of drain passages in communication with the bore, a pressure transmitting circuit defined in the housing and in communication with the bore, a relief valve which is in responsive communication with the pressure transmitting circuit for variably controlling the pressure in the inlet chamber, and a spool reciprocably disposed in the bore of the housing and having a plurality of lands for blocking communication between the inlet chamber and the service chambers in a neutral position, with the spool having metering slots for communicating fluid from the inlet chamber radially outwardly to a selected one of the service chambers and to the motor for operation thereof and for communicating return fluid from the other service chamber radially inwardly to a drain passage in a working position, and with the spool having openings for communicating the pressure transmitting circuit with a drain passage and unloading the relief valve in the neutral position and also for communicating the selected one of the service chambers to the circuit for loading the relief valve in the working position.

6 Claims, 4 Drawing Figures

CONTROL VALVE ARRANGEMENT WITH A PRECONDITIONED RELIEF VALVE AND A FLOW FORCE COMPENSATED VALVE SPOOL

BACKGROUND OF THE INVENTION

The present invention is related to an improved control valve arrangement for regulating fluid communication between a source of fluid under pressure and a hydraulic motor such as is used in adjusting the position of a double-acting hydraulic cylinder on earthmoving equipment. More particularly, the invention relates to such control valve arrangement having a pressure compensated flow control valve spool and relief valve combination with improved responsiveness to dynamic fluid forces acting on the spool in order to reduce to a minimum unbalanced axial forces exerted thereon.

In the control valve arrangements of U.S. Pat. No. 3,847,180 issued Nov. 12, 1974 to N. W. Kroth, et al., and U.S. Pat. No. 3,995,532 issued Dec. 7, 1976 to J. A. Junck, et al., both of which are assigned to the assignee of the present application, the pressure source or pump is in communication with an inlet chamber of the control valve and a relief valve to provide load responsive operating fluid flow and pressure when the control valve spool is conditioned to communicate fluid from the inlet chamber to the hydraulic motor or cylinder. The relief valve or dump valve is subject to variable loading such that in a neutral condition of the valve spool the fluid communicating with the inlet chamber is returned to the reservoir with the relief valve pressure setting established at a relatively low value so as to reduce heat generation and power consumption by the system. On the other hand, upon movement of the valve spool sufficient to direct fluid from the pump and the inlet chamber to a service chamber and the cylinder, the relief valve is subjected to the pressure in the service chamber so that it regulates the pressure in the inlet chamber to both the load pressure and the relief valve pressure setting as established by its biasing spring. Since the release pressure of the relief valve is thereby a function of the load pressure rather than a high fixed value, the control valve spool experiences reduced flow forces which facilitates its manipulation.

In the case of the valve arrangement of aforementioned U.S. Pat. No. 3,995,532, the relief valve is responsive to a fluid signal from the control valve for commencing modulation of the pressure in the inlet chamber when the control valve spool is moved to operate the cylinder prior to directly communicating the inlet chamber with a service chamber of the cylinder. This preconditioning of the inlet chamber pressure is a marked improvement over prior art arrangements, as it results in more responsive movement and control of the cylinder in the direction desired.

In addition to the relatively critical "timing" relationships between certain lands, passages and metering slots of the valve housing and the control valve spool which must minimize so-called "dead band" relationships and undesirable cross-flow or leakage which might result in poor control of any load on the cylinder, any arrangement of this type should also have a minimum of unbalanced axial forces acting on the spool when fluid is flowing dynamically past it. The magnitude of the axial forces acting on the spool under such conditions is related to the pressure drop urging fluid flow through the valve spool, the volume of fluid flowing past it, the flow area defined between the spool and housing, and the direction of fluid flow with respect to the spool axis. While the valve arrangement of previously discussed U.S. Pat. No. 3,995,532 has proven to be quite satisfactory, it does experience the generation of such unbalanced axial forces. Particularly, the metering-out forces generated by fluid flow radially outwardly from the spool axis and from the cylinder back to the reservoir are much greater in magnitude than the metering-in forces generated by fluid flow across the spool from the inlet chamber to the cylinder. However, since control of axial fluid flow forces in a metering-out form of construction is more difficult than in a metering-in construction, certain limitations are imposed upon the arrangement of U.S. Pat. No. 3,995,532 which result in the retention of some unbalanced forces on the valve spool.

SUMMARY OF THE INVENTION

The present invention is directed to overcoming one or more of the problems as set forth above.

According to the present invention, a control valve arrangement is disclosed for regulating fluid communication between a source of fluid under pressure and a doubleacting hydraulic motor, including a housing defining a bore, an inlet chamber in communication with the bore and the pressure source, a pair of service chambers in communication with the bore and the hydraulic motor for actuation thereof, and drain passages in communication with the bore; a pressure transmitting circuit defined in the housing and in communication with the bore; a relief valve which is in responsive communication with the pressure transmitting circuit for variably controlling the pressure in the inlet chamber; and a spool reciprocably disposed in the bore of the housing and having a plurality of lands for blocking communication between the inlet chamber and the service chambers in a neutral position, having metering slots therein for communicating fluid from the inlet chamber radially outwardly to a selected one of the service chambers and to the motor for operation thereof and for communicating return fluid from the other service chamber radially inwardly to the drain passages in a working position, and having openings therein for communicating the circuit with the drain passages and unloading the relief valve in the neutral position and also for communicating the selected one of the service chambers to the circuit for variably loading the relief valve in the working position.

DESCRIPTION OF THE PREFERRED EMBODIMENT

Figure 1:
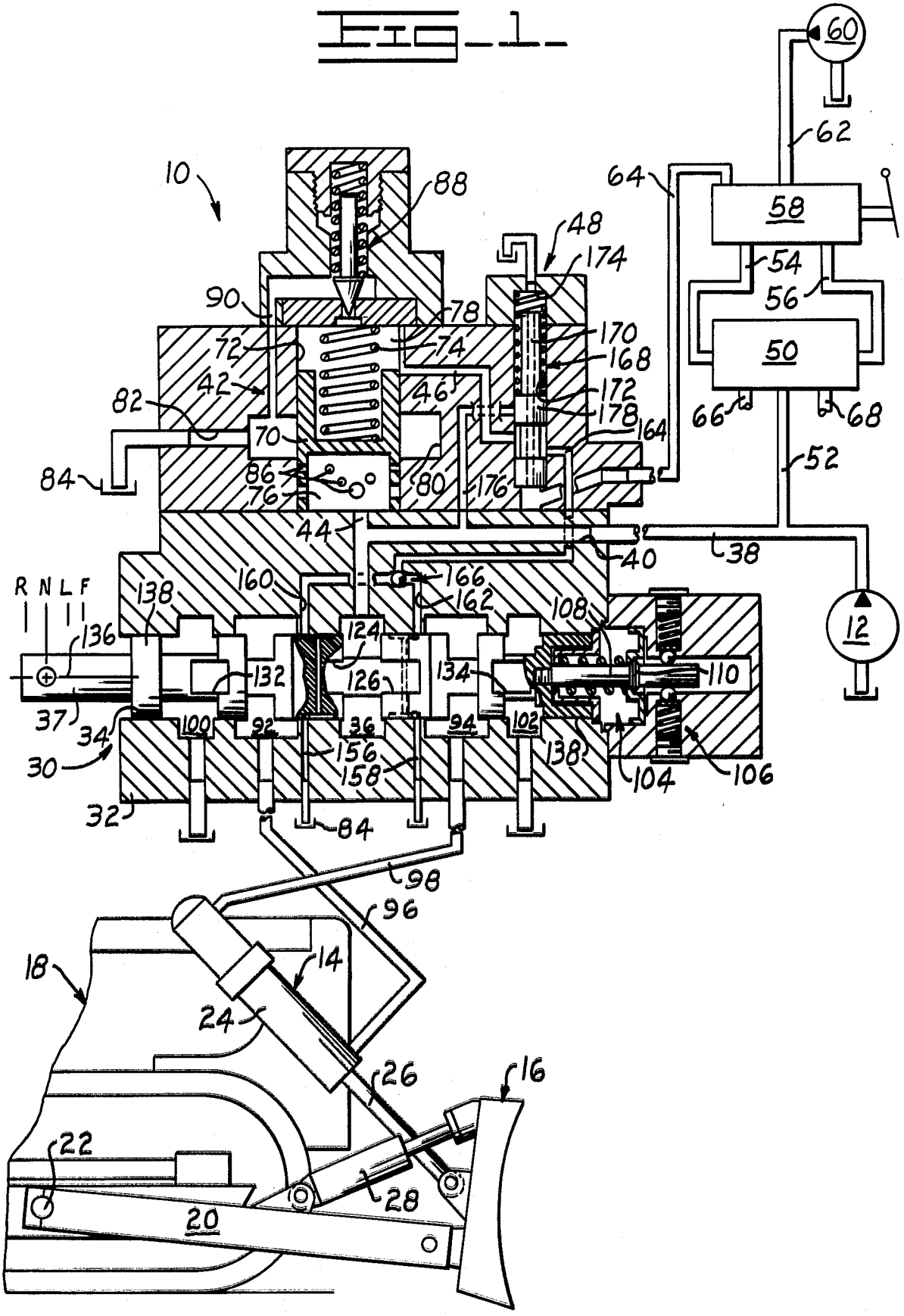
FIG. 1 is a diagrammatic representation of a control valve arrangement constructed in accordance with the present invention, and including certain portions in cross section to better illustrate details of construction thereof, which arrangement regulates fluid communication to a hydraulic motor or double-acting jack for manipulating the implement of an earthmoving machine.

A control valve arrangement constructed in accordance with the present invention is indicated by the reference numeral 10 in FIG. 1 for regulating fluid flow from a pump or source of fluid under pressure 12 to a hydraulic motor or double-acting hydraulic jack 14. In the instant example, the hydraulic jack causes vertical displacement of an implement 16 on an earthmoving machine such as a track-type tractor 18.

As shown in the drawing, the implement 16 is a bulldozer blade having a pair of push arms 20 mounted at their inner ends to the tractor 18 via pivot connections 22. Although one of the jacks 14 is secured to the blade at each side of the tractor in the usual manner, only one need be described. The jack includes a cylinder 24 having an extensible rod 26 therein, the cylinder and rod being pivotally interconnected between the tractor and the blade so that adjustment of the jack serves to raise and lower the blade. Additional motors or jacks, such as that indicated at 28, may be pivotally interconnected between the blade and the push arms, for example, to regulate pitching and/or tilting of the blade relative to the tractor in a conventional manner.

The control valve arrangement 10 includes a selector control valve 30 having a valve body or housing 32 defining a spool receiving bore 34 and an inlet chamber 36 in communication with the bore. A selector spool 37 is reciprocably disposed within the bore to selectively communicate fluid entering the inlet chamber from the pump 12, a conduit 38, and an internal passage 40, with the opposite ends of the hydraulic jack 14 in a manner which will be described in greater detail below.

In general, the control valve arrangement 10 also includes a pressure relief valve or dump valve 42 which is disposed in the housing 32 in communication with a branch passage 44 leading to the internal passage 40 and the inlet chamber 36 for modulating fluid pressure therein. The opposite or upper end of the pressure relief valve is in communication with an internal passage 46 and a signal transmitting circuit 48 for variably loading the relief valve as a function of the load pressure at one end of the hydraulic jack 14. With this arrangement, fluid pressure in the inlet chamber 36 may be modulated to a relatively minimum pressure, for example 80 psi, when the selector spool 37 is disposed in its neutral or holding position as shown. Accordingly, the pump 12, which operates against this low pressure, consumes a minimum amount of power and there is relatively little heat generation within the control valve arrangement while fluid is being vented or relieved from the branch passage 44 and the inlet chamber.

As indicated diagrammatically at the upper right when viewing FIG. 1, the control valve arrangement 10 is also adapted for operation of an additional motor or double acting hydraulic jack, not shown, such as may be used for regulating the position of a ripper. Such auxiliary jack is adjusted or manipulated by a second selector control valve 50 which is also in communication with the pump 12 through the conduit 38 and the branch conduit 52. In the example illustrated, the control valve 50 is pilotably operated by communicating fluid pressure thereto by means of either a conduit 54 or a conduit 56 upon the selective manipulation of a manually operated pilot control valve 58. The pilot control valve receives fluid under pressure from a second pump 60 through a conduit 62, and delivers a pressure signal to another conduit 64 whenever either of the conduits 54 or 56 is pressurized for the purpose hereinafter to be described. However, it should be appreciated, that whenever the pilot control valve 58 is selectively manipulated, the control valve 50 is positioned to selectively communicate fluid pressure from the branch conduit 52 to either of a pair of service conduits 66 and 68 leading to the opposite ends of the auxiliary jack for operation thereof.

The pressure relief valve 42 includes a spool or piston 70 which is slidably disposed within a bore 72 in the housing 32. As is apparent when viewing FIG. 1, the spool is urged downwardly towards a closed position by a compression spring 74. Further, the relief valve spool divides the bore into a first chamber 76 disposed at the lower end of the bore and in communication with the branch passage 44, and a second chamber 78 disposed at the upper end of the bore which is in open communication with the internal passage 46. Moreover, an annular recess 80 opens centrally of the bore and communicates with a drain passage 82 in the housing to return fluid back to a reservoir as hereinafter indicated generally by the reference numeral 84. A lower portion of the relief valve spool is formed with a plurality of axially offset and variably sized ports 86 in order to modulate fluid flow from the lower chamber 76 into the annular recess 80 as the spool is urged upwardly against the action of the compression spring 74.

In the neutral condition of the selector spool 37, the upper chamber 78 of the relief valve 42 is open to the reservoir 84 through the signal transmitting circuit 48 so that the movement of the spool 70 is opposed solely by the compression spring 74. At other times, the upper chamber is normally pressurized to variably load the relief valve as a function of the spring load and the load pressure at one end of the hydraulic jack 14. Since pressure in the upper chamber is then proportional to pressure observed in the inlet chamber 36, a poppet-type relief valve 88 opens thereon to relieve excessive pressure therein. For example, the poppet relief valve may be designed to open at 2,500 psi, whereupon fluid within the upper chamber is relieved to the annular recess 80 through an internal passage 90 communicating therebetween.

Referring now to the construction of the selector control valve 30 in greater detail, an annular service chamber 92 and an annular service chamber 94 are defined in the housing 32 which open on the bore 34 in symmetrically spaced apart relation on the opposite sides of the inlet chamber 36. The left service chamber when viewing the drawing is in continual communication with the rod end of the cylinder 24 by way of a conduit 96, while the other service chamber 94 is in similar communication with the head end of the cylinder by way of a conduit 98. In a similar manner an annular drain chamber 100 and another annular drain chamber 102 are arranged to open on the bore in symmetrically spaced apart relation from the service chambers and generally at the opposite ends of the spool bore.

In general, the selector spool 37 has a plurality of lands which are so constructed as to block the inlet chamber 36, the service chambers 92 and 94, and the drain chambers 100 and 102 in the neutral position illustrated in FIG. 1 and identified by the letter "N." The spool is selectively movable toward the left when viewing the drawing into a raise position indicated by the letter "R" for directing fluid under pressure from the inlet chamber through the service chamber 92, and the conduit 96 into the rod end of the hydraulic jack 14 in order to elevate the bulldozer blade 16. The spool is also movable to the right into a lower position indicated by the letter "L" for communicating fluid under pressure from the inlet chamber through the service chamber 94 and the conduit 98 into the head end of the jack for lowering the blade. In addition, the spool has a float position indicated by the letter "F" wherein each end of the hydraulic jack and the inlet chamber are placed in communication with one of the drain chambers 100 and 102 so that the blade is permitted to float along the contour of the ground.

The selector spool 37 is biased into its centered neutral position "N" by a relatively low force centering spring assembly 104 which tends to facilitate operator control of the control valve 30. An opposed ball detent mechanism 106 cooperates with a cylindrical extension 108 of the spool and an annular ramp 110 on the extension to permit retention of the spool in the float position.

Figure 2:
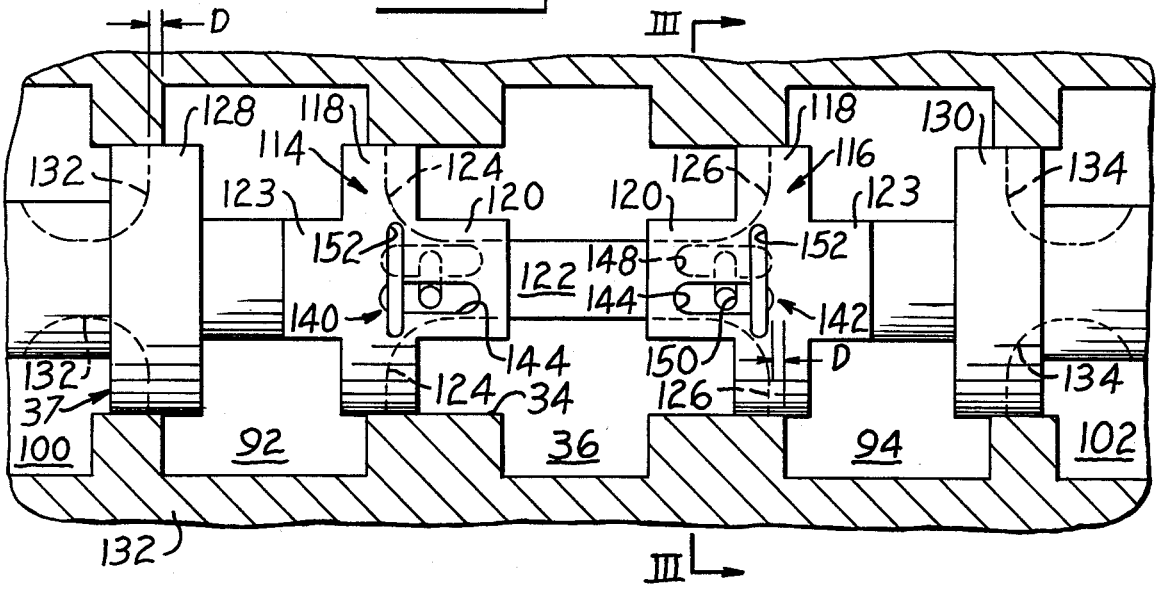
FIG. 2 is an enlarged fragmentary section of the housing and control valve spool illustrated in FIG. 1, only showing the spool at right angles to the position illustrated in FIG. 1 to better illustrate details of its construction.

Referring also now to FIG. 2, it may be seen that the selector spool 37 is formed with a pair of spaced apart and specifically profiled lands 114 and 116 of somewhat cross-shaped exterior appearance which cooperate with the bore 34 when the spool is in its neutral position to block communication between the inlet chamber 36 and either of the service chambers 92 or 94. Each of these symmetrically opposite lands includes an annular portion 118, a diametrically opposite pair of narrow legs 120 which extend axially inwardly toward a central neck portion 122, and a diametrically opposite pair of narrow legs 123 which extend axially outwardly therefrom. A pair of arcuately formed metering slots 124 is formed in the left land 114 at a normal or right angle to each of the legs 120 to communicate the inlet chamber with the service chamber 92 when the spool is moved leftwardly away from the position shown. In a similar manner, another pair of metering slots 126 is symmetrically formed on the opposite land 116 to communicate the inlet chamber with the other service chamber 94 upon movement of the spool rightwardly away from its neutral position. Another pair of annular lands 128 and 130 is formed on the spool, which lands are individually positioned between the service chamber 92 and the drain chamber 100, and the service chamber 94 and the drain chamber 102, respectively when the spool is in neutral. A pair of diametrically opposite arcuate metering slots 132 are formed in the spool in partially outwardly intersecting relation with the land 128 to provide selectively variable fluid communication between the service chamber and drain chamber. Another pair of metering slots 134 are formed in the other end of the spool which similarly intersect the land 130. In this manner, the metering slots 124, 126, 132 and 134 are all generally aligned along a horizontal plane 136 passing centrally through the axis of the spool as shown in FIG. 1. Lastly, a pair of annular end lands 138 serve to block the opposite ends of the bore 34.

Figure 3:
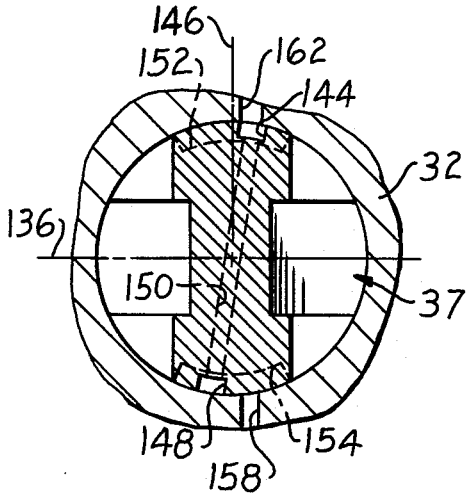
FIG. 3 is an enlarged fragmentary section of the control valve spool and housing illustrated in FIGS. 1 and 2 and as taken along the line III—III of FIG. 2.

More specifically, each of the lands 114 and 116 is provided with a plurality of profiled openings and grooves as generally indicated by the reference numerals 140 and 142, respectively, the size and relative arrangement of which is of critical importance to the present invention as will be made clear below. However, it may be noted from FIGS. 2 and 3 that the openings 142 include an axially elongated or longitudinal slot 144 at the top of the spool which is laterally offset a predetermined distance from a vertical plane 146. Another longitudinal slot 148 of the same length and shape is disposed oppositely to the slot 144 and is laterally offset on the opposite side of the vertical plane. An obliquely disposed drain passage 150 continually permits communication between these two longitudinal slots, and a laterally elongated or transverse slot 152 and a similar transverse slot 154 diametrically opposite thereto respectively intersect the longitudinal slots. In this way the set of intersecting slots 144 and 152 form a T-shaped recess at the top of the spool, while the other slots 148 and 154 form another T-shaped recess at the bottom. These recesses are adapted to open upon certain passages of the signal transmitting circuit 48 as will be hereinafter described, it being appreciated that the axially displaced openings and grooves 140 are of identical construction.

As best shown in FIG. 1, the signal transmitting circuit 48 includes a pair of drain passages 156 and 158 which open on the bore 34 and are in communication with the fluid reservoir 84. Somewhat dametrically oppositely therefrom a pair of signal transmitting passages 160 and 162 are formed in the valve housing 32 and are in selected communication with another passage 164 through a ball resolver valve 166. This passage 164 is in normal communication, over a shuttle valve 168, with the passage 46 communicating with the upper chamber 78 of the relief valve 42. However, such communication is automatically interrupted by shifting of the shuttle valve.

The shuttle valve 168 includes a shuttle spool 170 arranged within a bore 172 in housing 32, and is urged downwardly when viewing the drawing by a compression spring 174. The lower portion of the spool and the bore are in communication with the conduit 64 leading to the pilot control valve 58. Another passage 176 in the housing communicates with the inlet conduit 38 and the bore, but is blocked by a spool land 178 in the position illustrated. With this construction, the passages 46 and 164 are normally in open communication; however, when the auxiliary motor is operated by selective manipulation of the control valve 58, the conduit 64 is pressurized to urge the shuttle spool upwardly so that passage 164 is thereafter blocked and there is free communication between the inlet conduit 38 and the passage 46 by way of the passage 176 and the spool bore. Accordingly, with the shuttle valve maintained in its raised position, the upper chamber 78 of the relief valve 42 experiences substantial equal pressurization as the lower chamber 76, thus enabling the relief valve to act as a pilot operated relief valve during operation of the second control valve 50. Once the manual pilot control valve 58 is repositioned to terminate the operation of the second control valve, the fluid signal in the conduit 64 is discontinued and the shuttle valve 168 is repositioned downwardly to provide normal communication between the passages 46 and 164.

Returning to the construction of the selector spool 37, it is again noted that the size and relative location of the openings 140 and 142 and their relationship to the generally diametrically opposite passages 156 and 160, as well as 158 and 162 is of paramount importance to the present invention. For example, in the neutral position of the spool shown, the leftward lower transverse slot 154 is in open communication with the drain passage 156, while the upper transverse slot 152 is in open communication with the signal transmitting passage 160. In a corresponding manner the signal passage 162 is arranged in communication with the upper transverse slot and the drain passage 158 is in communication with the lower transverse slot of the second set of openings. Since the drain passages 150 formed through the spool always communicate flow between the transverse slots, both of the signal passages are open to the reservoir 84 and consequently the upper chamber 78 of the relief valve 42 is open to drain. As the spool is shifted in either direction from its neutral position, for example, toward the right a distance identified by the letter "D" into a position wherein the right ward longitudinal slots 144 and 148 pass into open communication with the service chamber 94, then the signal transmitting passage 162 experiences the pressure in the service chamber. Such communication is achieved before the other signal transmitting passage 160 passes out of register with the drain passage 156 through the leftwardly disposed openings 140. Similarly, as to the spool is moved to the left, the signal transmitting passage 160 will be communicated with the service chamber 92 before the opposite signal transmitting passage 162 passes out of register with the drain passage 158 through the openings 142. This feature of the control valve 30 assures that the upper chamber 78 of the relief valve 42 is always in positive communication with one of the service chambers or a fluid drain. Accordingly, the possibility of a "hydraulic lock" behind the relief valve spool 70 is prevented to thereby maintain positive control of the inlet pressure.

It is important to note that one of the service chambers 92 or 94 is communicated with one of the signal passages 160 or 162 as described immediately above prior to communication of the inlet chamber 36 with either of the service chambers by way of either the metering slots 124 or 126 respectively. Accordingly, the relief valve 42 commenses to modulate fluid pressure within the inlet chamber before the inlet chamber is placed in communication with a service chamber. This "pre-conditioning" of the inlet pressure tends to prevent any delay in operation of the hydraulic jack 14 once the inlet chamber is placed in communication with one of the service chambers through the metering slots.

Figure 4:
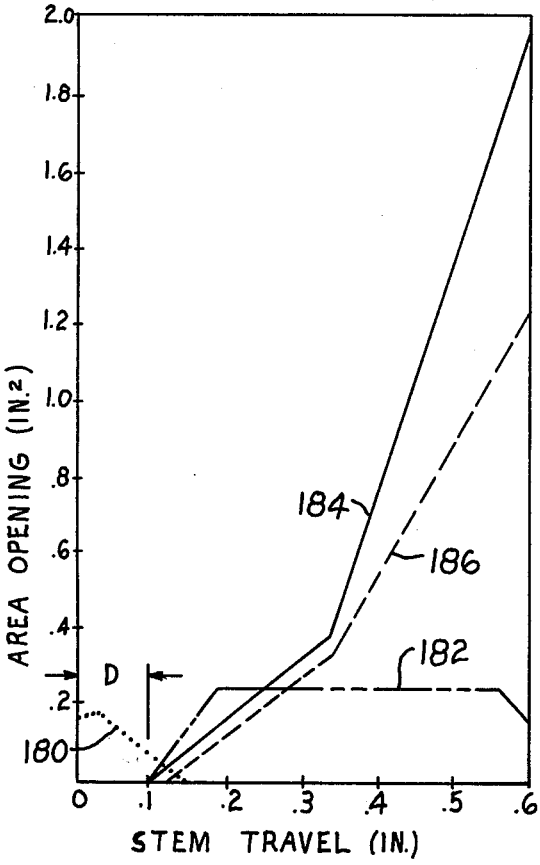
FIG. 4 is a graph illustrating the opening area of various metering slots and passages in the control valve arrangement of the present invention as a function of the amount of axial movement of the control spool from a centered or neutral position.

The critical timing feature of the control valve arrangement 10 of the present invention may be explained with respect to the graph of FIG. 4, which relates the opening area of certain passages relative to the travel of the selector spool 37 to the right for achieving extension of the hydraulic jack 14 and lowering of the bulldozer blade 16. As the spool is shifted to the right, the upper left transverse slot 152 gradually closes off its communication with the signal transmitting passage 160. Such decrease in opening is represented by the dotted line trace in FIG. 4 designated by the numeral 180. Upon moving the selector spool a predetermined distance "D" to the right as illustrated, the longitudinal slots 144 and 148 of the right profiled openings 142 are placed in open communication with the service chamber 94. Since these slots are also in communication with the signal passage 162 shown in FIG. 1, the service chamber pressure is communicated to the ball resolver 166 to move it to the left to a position blocking the signal passage 160 and allowing the load pressure of the jack 14 to be thereafter communicated to the upper chamber 78 of the relief valve 42 by way of the passages 164 and 46. In this way the ball resolver prevents service chamber to reservoir leakage flow therethrough. This increased area of the opening to communicate pressure fluid to the spring chamber is represented in the graph by the phantom line designated by the reference numeral 182. Simultaneously therewith, the metering slots 132 at the leftward end of the selector spool are moved to the right sufficiently to communicate the opposite service chamber 92 with the drain chamber 100. The gradual increase in opening of these metering slots is represented by the solid line trace in FIG. 4 identified by the numeral 184. As indicated by the broken line 186 in the graph, it is not until the spool is moved an additional predetermined distance that the metering slots 126 are allowed to directly communicate fluid flow between the inlet chamber 36 and the service chamber 94. In accordance with one feature of the invention, however, it is to be noted that fluid flow then occurring through the metering slots 126 is in a "meter-out" direction. Such meter-out flow is achieved under a condition of a relatively low pressure drop equal to the initial setting of the relief valve 42 because the inlet pressure has been preconditioned as described previously. In contrast thereto, the opposite metering slots 132 are metering fluid to the drain chamber through a "meter-in" action. Such action is achieved at a relatively greater pressure drop between the chambers 92 and 100, for example in the order of approximately 500 psi under normal operating conditions. Consequently, it is apparent that the present invention utilizes metering-in slots 132 which provide the best opportunity to control the shifting efforts of the selector spool at a location where a relatively high pressure drop and associated high axial flow force is experienced as a result of directing return fluid back to the reservoir from the hydraulic jack. Since the metering-out slots 126 offer less control over such fluid flow forces, they are associated with the relatively constant and low pressure drop experienced between the inlet chamber and a service chamber.

From the above description, it is readily apparent that there is disclosed a control valve arrangement for regulating fluid communication between a source of fluid pressure and a double-acting hydraulic motor which will exhibit a minimum of unbalanced axial fluid forces on the selector spool thereof. This is achieved by providing a predetermined series of openings and passages in the selector spool and housing so that the relief valve associated with the control valve arrangement is subject to variable loading so as to provide a relatively low pressure relief setting in neutral and a load-related pressure setting upon selective movement of the control spool, and prior to actual communication between the inlet chamber and the hydraulic jack for operation thereof. Still further, certain metering-out slots are utilized for controlling fluid flow across the selector spool under conditions of relatively low pressure drop, and certain other metering-in slots are also provided wherein the pressure drop across the spool is relatively high to control the axial forces on the spool and make it easier and more sensitive to manipulation.

While the invention has been described and shown with particular reference to a preferred embodiment, it will be apparent that variations might be possible that would fall within the scope of the present invention, which is not intended to be limited except as defined in the following claims.

The embodiments of the invention in which an exclusive property or privilege is claimed are defined as follows:

1. In a control valve arrangement, for regulating fluid communication between a source of fluid under pressure and a double-acting motor, of the type having a housing defining a bore, an inlet chamber in communication with the bore and the pressure source, a pair of service chambers in communication with the bore and the motor for actuation thereof, and a pair of drain chambers in communication with the bore; a pressure transmitting circuit connected to the housing and in communication with the bore; a relief valve in responsive communication with the pressure transmitting circuit for variably controlling the pressure in the inlet chamber; and a single spool reciprocably disposed in the bore of the housing and having a plurality of spaced, raised lands for blocking communication between the inlet chamber, the service chambers, and the drain chambers in a neutral position; wherein the improvement comprises:

a pair of drain passages in communication with the bore;

metering slot means in the spool for communicating fluid from the inlet chamber radially outwardly to a selected one of the service chambers and to the motor for operation thereof and for communicating return fluid from the other service chamber radially inwardly to a selected one of the drain chambers in a working position; and opening means in the spool for communicating the circuit with the drain passages and unloading the relief valve in the neutral position, for communicating the selected one of the service chambers to the circuit for variably loading the relief valve in a preconditioning position of the spool between the neutral and working positions, and for communicating the selected one of the service chambers to the circuit for variably loading the relief valve in the working position.

2. The control valve arrangement of claim 1 wherein the pressure transmitting circuit includes a pair of signal transmitting passages opening on the bore and the pair of drain passages open on the bore substantially oppositely of the signal transmitting passages.

3. In a control valve arrangement for regulating fluid communication between a source of fluid under pressure and a double-acting motor, of the type having a housing defining a bore, an inlet chamber in communication with the bore and the pressure source, a pair of service chambers in communication with the bore and the motor for actuation thereof, and a pair of drain chambers in communication with the bore; a pressure transmitting circuit connected to the housing and in communication with the bore; a relief valve in responsive communication with the pressure transmitting circuit for variably controlling the pressure in the inlet chamber; and a spool reciprocably disposed in the bore of the housing and having a plurality of spaced, raised lands for blocking communication between the inlet chamber, the service chambers, and the drain chambers in a neutral position; wherein the improvement comprises:

a pair of drain passages in communication with the bore;

metering slot means in the spool for communicating fluid from the inlet chamber radially outwardly to a selected one of the service chambers and to the motor for operation thereof and for communicating return fluid from the other service chamber radially inwardly to a selected one of the drain chambers in a working position; and opening means in the spool for communicating the circuit with the drain passages and unloading the relief valve in the neutral position, for communicating the selected one of the service chambers to the circuit for variably loading the relief valve in a preconditioning position of the spool between the neutral and working positions, and for communicating the selected one of the service chambers to the circuit for variably loading the relief valve in the working position, wherein the opening means in the spool includes a pair of passage sets with each set including substantially diametrically opposite recess means interconnected by a passage through the spool.

4. The control valve arrangement of claim 3 wherein the recess means includes a transverse slot and an intersecting longitudinal slot.

5. An improved control valve arrangement, for regulating fluid communication between a source of fluid under pressure and a double-acting hydraulic jack, of the type having a housing defining a bore, an inlet chamber in communication with the bore and the pressure source, a pair of service chambers in communication with the jack for operation thereof and opening on the bore axially outwardly of the inlet chamber, a pair of drain chambers opening on the bore axially outwardly of the service chambers, a pressure transmitting circuit connected to the housing and communicating with the bore, a relief valve which is in responsive communication with the pressure transmitting circuit for variably controlling the pressure in the inlet chamber, wherein the improvement comprises:

a pair of drain passages opening on the bore; and a single spool reciprocably disposed in the bore of the housing and having a plurality of spaced, raised lands for blocking communication between the inlet chamber, the service chambers, and the drain chambers in a neutral position, having metering slot means for communicating fluid from the inlet chamber radially outwardly to a selected one of the service chambers and to the jack for operation thereof and for communicating return fluid from the other service chamber radially inwardly to one of the drain chambers, and having opening means for communicating the circuit with the pair of drain passages and unloading the relief valve in the neutral position, for communicating the selected one of the service chambers to the circuit for loading the relief valve in a preconditioning position of the spool between the neutral and working positions, and for communicating the selected one of the service chambers to the circuit for loading the relief valve in the working position; wherein the opening means formed in the spool includes a pair of axially spaced apart passage sets individually having diametrically opposite slot means and a through passage for cross connecting the slot means.

6. The control valve arrangement of claim 5 wherein each slot means is in the form of a T-shaped recess.

* * * * *